US006659493B1

(12) United States Patent
Trnka

(10) Patent No.: US 6,659,493 B1
(45) Date of Patent: Dec. 9, 2003

(54) CONNECTOR PLATE FOR BINDINGS

(76) Inventor: Milan Trnka, Cyrila Boudy 1584, 272 01, Kladno (CZ)

( * ) Notice: Subject to any disclaimer, the term of this patent is extended or adjusted under 35 U.S.C. 154(b) by 0 days.

(21) Appl. No.: 09/959,729

(22) PCT Filed: May 10, 2000

(86) PCT No.: PCT/CZ00/00032

§ 371 (c)(1),
(2), (4) Date: Nov. 5, 2001

(87) PCT Pub. No.: WO00/69980

PCT Pub. Date: Nov. 23, 2000

(30) Foreign Application Priority Data

May 14, 1999 (CZ) ..... 1718-99

(51) Int. Cl.[7] ..... A63C 5/075; A63C 1/24
(52) U.S. Cl. ..... 280/607; 280/602; 280/11.14
(58) Field of Search ..... 280/618, 620, 280/633, 636, 634, 11.14, 14.22, 14.24, 602, 607, 11.28

(56) References Cited

U.S. PATENT DOCUMENTS

| | | | | | |
|---|---|---|---|---|---|
| 3,797,839 | A | * | 3/1974 | Smolka et al. | 280/602 |
| 5,046,751 | A | * | 9/1991 | Scherubl | 280/607 |
| 5,143,395 | A | | 9/1992 | Mayr | |
| 5,647,605 | A | * | 7/1997 | Arduin | 280/602 |
| 5,671,939 | A | | 9/1997 | Pineau | |
| 5,758,894 | A | * | 6/1998 | Maggiolo | 280/602 |
| 5,775,717 | A | * | 7/1998 | Bobrowicz | 280/607 |
| 5,845,923 | A | * | 12/1998 | Zanco | 280/607 |
| 5,927,743 | A | * | 7/1999 | Mantel | 280/602 |
| 5,984,344 | A | * | 11/1999 | Harsanyi et al. | 280/602 |
| 6,102,425 | A | * | 8/2000 | Gotzfried | 280/602 |
| 6,227,558 | B1 | * | 5/2001 | Arduin et al. | 280/611 |
| 6,412,807 | B1 | * | 7/2002 | Arduin et al. | 280/607 |

FOREIGN PATENT DOCUMENTS

| | | |
|---|---|---|
| DE | 198 36 515 | 2/1999 |
| EP | 0 469 452 | 7/1991 |
| EP | 0 612 543 | 6/1996 |
| FR | 2 768 937 | 4/1999 |

OTHER PUBLICATIONS

International Publication No. WO 92/22361, Trimble, Ski Binding Block, Dec. 23, 1992.
International Publication No. WO 88/01190, Rullier et al., Dampener for Dampening Shocks and Vibrations Between A Ski and the Shoe Binding, Feb. 25, 1988.

* cited by examiner

*Primary Examiner*—Brian L. Johnson
*Assistant Examiner*—Jeffrey J. Restifo
(74) *Attorney, Agent, or Firm*—Dykema Gossett PLLC

(57) ABSTRACT

A connector plate for ski bindings of snow skis and snowboards consists of two connecting segments (1), constructed from an elastic layer (2) made of an elastic material, for example rubber or silicon, within which located along its lateral axis which lies perpendicular to the longitudinal axis of the ski (4) or snowboard, is at least one solid supporting element (3), which divides the elastic layer (2) into two regions, one region is compressed and the other expands during the flexing of the ski (4) or snowboard, in addition the construction allows for longitudinal movement in the elastic layer (2) of the connecting segments (1), all of which takes place while both connecting segments are interconnected via their upper surface.

18 Claims, 3 Drawing Sheets

FIG. 7
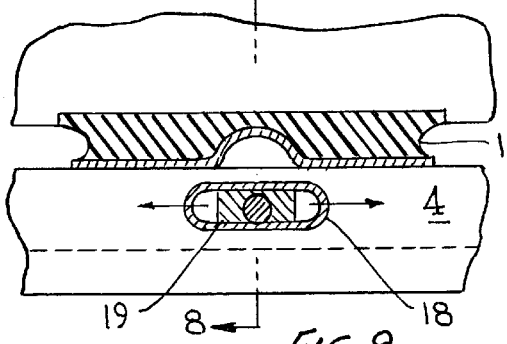
FIG. 8
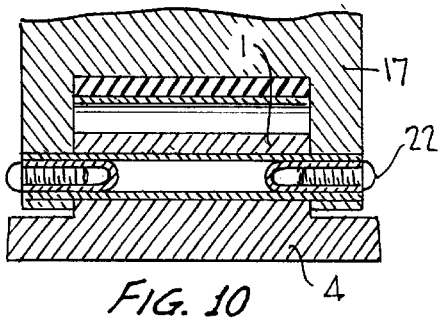
FIG. 9
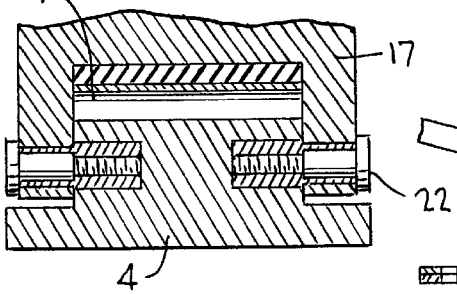
FIG. 10
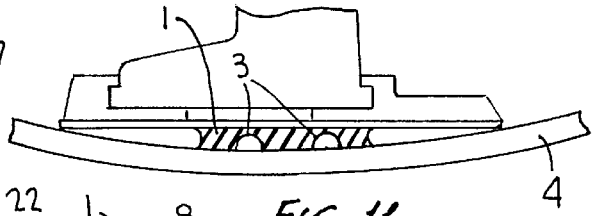
FIG. 11
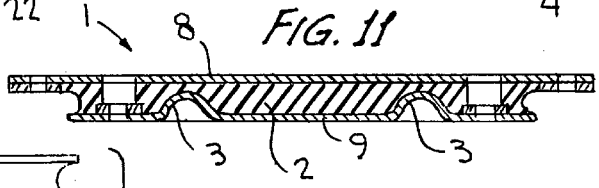
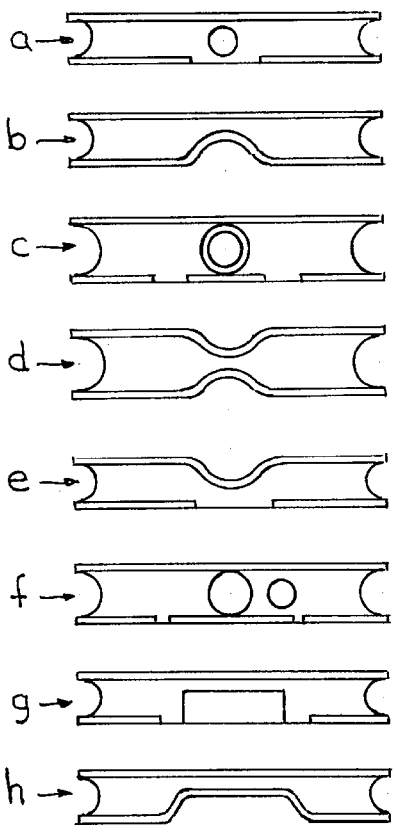
FIG. 12

CONNECTOR PLATE FOR BINDINGS

FIELD OF THE INVENTION

The invention relates to a connector plate for bindings, specifically the toe and heal pieces of snow ski bindings or bindings for snowboards, which allows the ski or snowboard to flex freely under the ski boot of the skier or snowboarder.

BACKGROUND OF THE INVENTION

The most common method of securing a ski binding is by mounting it directly onto the ski, this method however, has the undesired effect of stiffening the ski in the region of the ski binding, more precisely the area underneath the boot of the skier. This stiffening effect is a result of resistant pressure created by the combined effect of the boot and binding during the normal flexing of a snow ski during a turn. The natural flexing of a ski is in this way inhibited, such that it has a negative effect on skiing, more specifically in the turning of the ski—an act achieved by angling the ski onto its side, thus causing the ski by bending to produce an arc. The ideal arc or bend of a ski due to the most common method of mounting ski bindings is therefore not achieved.

Another method of securing ski bindings is via an intermediate plate, whose lower surface is mounted onto the ski; respectively the ski binding is mounted on its upper surface. In both cases screws are used in the mounting process. The outcome of this method is that the ski boot is secured higher off the snow. This is advantageous to the skier as the ski boot, which is wider than the ski and so is limiting in the angling on the ski in turning as described above—is given more clearance, thus enabling greater angling of the ski.

To improve the flexing of the ski under the region of the ski boot, a flexible intermediate plate is commonly used which flexes together with the ski and is more or less a part of the ski. This intermediate plate is attached by screws or elastic glue, either directly to the upper surface of the ski or via an additional elastic layer, which allows restricted longitudinal movement such that it absorbs the shortening of the ski during flexing. However this measure fails to account for the inner tension resulting form resistant force from the ski boot onto the bindings exerted during the flexing of a ski, which relates to the before mentioned disadvantages. An example of this kind of solution is demonstrated in patent EP 612543.

The use of various flexible constructions underneath ski bindings is common, for example patent WO 92/22361, according to which the ski boot is secured on top of two compressible segments. The main goal of this kind of arrangement is to dampen the vibration of the ski. This technique does not however allow the required range of movement necessary for the ideal flexing of the ski, as both segments flex together with the ski, thus exerting a compressive force on the ski boot. Consequently the resistance given by the ski boot inhibits the ski from flexing freely. A similar solution in mounting bindings is demonstrated in patent WO 88/01190, according to which the bindings are mounted on a plate, which is separated from the ski by a vibration-dampening unit made of an elastic-viscous material. Once again however this arrangement fails to allow the ski to flex freely.

SUMMARY OF THE INVENTION

Two connector plates between the mounting for bindings and the ski or snowboard overcome these inadequacies in the present developments to allow uninhibited flexing of skis. The functional components of this design are two connecting segments. Each segment has a flexible layer of an elastic material, fore example rubber or silicon. According to the invention, the elastic layer of the segment includes at least one solid supporting element separating the elastic layer into two regions; it is to be noted that this supporting element is located perpendicular to the longitudinal axis of the ski. During the flexing of the ski one of these regions is compressed while the other expands. These connecting segments have two surfaces between which the design allows for limited movement longitudinally. Both connecting segments are interconnected via their upper surfaces.

The advantage of this invention is that it not only allows for longitudinal movement between the two surfaces of the connecting segments, but also for pivoting along the lateral axis, both of which are necessary for uninhibited flexing of a ski or snowboard, underneath the region of the boot. This pivoting occurs around the lateral axis provided by the solid supporting element, while any rotation along the longitudinal axis as well as any lateral movements are prevented. Additionally, as a whole the connector plate acts as a vibration-dampening device, as well as raising the boot above the ski or snowboard. The ideal distance between the two connecting segments is the length of the sole of the boot. As the ski bindings are mounted on an interconnecting rigid plate separated from the ski, all forces are eliminated, and therefore optimum boot-binding connection is achieved.

The design of the invention can be utilized by attaching the connecting segments to both the toe and heal pieces of the ski binding, by means of vulcanizing or gluing the elastic layer to the corresponding parts. Alternatively, the segments can be secured to an intermediate plate as described earlier, and finally both connecting segments can be integrated directly into the ski or snowboard.

For the mounting of most known brands of ski bindings on either skis or snowboards, the elastic layer of both connecting segments is constructed with an upper mounting plate, modified for the mounting of ski bindings and a lower mounting plate, modified for mounting the segments onto the ski or snowboard. The elastic layer is secured to both mounting plates via the process of vulcanization. Taking advantage of the connector plate design, it's two connecting segments can be used as components of the ski bindings, by being affixed to the lower surfaces of the toe and heal pieces of ski binding and in so doing taking on the function of the upper mounting plate.

The solid supporting element can take on a variety of forms and be constructed from a variety of densities. Furthermore the solid supporting element can be constructed as an extension of either the upper mounting plate or lower mounting plate or a combination of both. Alternatively it can be inserted as a separate independent component between the two mounting plates, with which it can either be in contact with or sit in between them in which case in at least one of the mounting plates a gap is left which is filled with rubber.

The solid supporting element can alternatively be constructed as a solid jacket, within which is located a runner capable of moving longitudinally along the longitudinal axis of the connecting segment, the space around the runner is filled with either rubber or some other elastic material. This type of supporting element can be used as a component of the snow ski, in which case it is either affixed to the upper surface of the ski or inserted directly through it. This allows the supporting element the additional function of a securing component for the connector plate onto the ski or snowboard. In a simplified example of this variation, the runner can be set directly in the elastic layer or other elastic material.

In a further variation, the supporting element is constructed from an extension of either the upper or lower mounting plates into the elastic layer. In the case of the lower mounting plate, the extension causes the plate to be more flexible and therefore aiding in the overall flexing of the ski.

In the ease of the previous variation, the upper and lower mounting plates can be connected by two density adjusting screws, which are secured in the axis of the supporting element, which in this case the extension of either the upper or lower mounting plates.

Alternatively the required density of the connecting segment can be achieved by the separation of the mounting plates into two or more sections which are connected via the elastic layer, more precisely by vulcanizing them with rubber or some other elastic material, which forms the this elastic layer.

Although the axis of the solid supporting element is located on the (transverse or lateral) axis of the connecting segment according to the invention, this however is not a necessity, and the supporting element can be located off center of this axis without departing from the invention.

As to accommodate for varying requirements, the elastic layer can be formed from a range of elastic materials of varying degrees of density, in addition to this the elastic layer can be formed with internal cavities.

By virtue of the design, the connecting segments of the connector plate, via the upper mounting plate can be set apart optimally according to the size of the ski boot of the skier.

Alternatively, a rigid plate, adapted for the mounting of ski bindings can interconnect both of the connecting segments.

In addition, it is beneficial to the overall performance of the ski for a dampening unit to be affixed between the two connecting segments, which resist the reverse flexing of the ski.

Further still, both connecting segments can be constructed as one unit, in which case the construction is mounted in the middle of the ski boot.

All of the above mentioned structural variations of the invention allow free and therefore ideal flexing of a snow ski or snowboard along its entire length. This smooth flexing together with the side cut of snow skis or snowboards result in uninhibited carved turns. With the connector plate not only do the skis or snowboard turn and flex better but also absorb vibration better, these improvements distinguish themselves most noticeably in skiing on icy or rough and uneven terrain. In addition the invention distinguishes itself in its universality, it can be used for all types of ski and snowboards and all types of bindings. Finally the benefits of this invention are most prominent in skis with extreme side cuts, referred to as carving skis.

BRIEF DESCRIPTION OF THE DRAWINGS

The invention will be further clarified through a variety of drawings of possible variations, these are as follows:

FIG. 7 is a side view of connecting segment (further variation).

FIG. 8 is a sectional view taken along line 8—8 of FIG. 7.

FIG. 9 is a front view of connecting segment of FIG. 7, (further variation).

FIG. 10 is a side view of the connector plate, mounted on the ski, as one unit.

FIG. 11 is a detailed side view of the connector plate of FIG. 10.

FIGS. 12 *a*) to *h*) are schematical views of further varieties of connecting segments.

DESCRIPTION OF THE PREFERRED EMBODIMENT

EXAMPLE 1

Figure 1A:
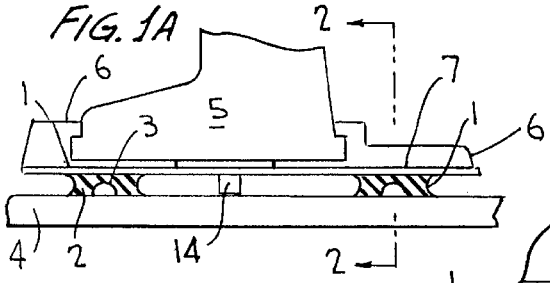
FIGS. 1A and 1B are schematic side views of a ski boot mounted to a ski with a connector plate according to the invention, shown without and with the ski flexing.
Figure 2:
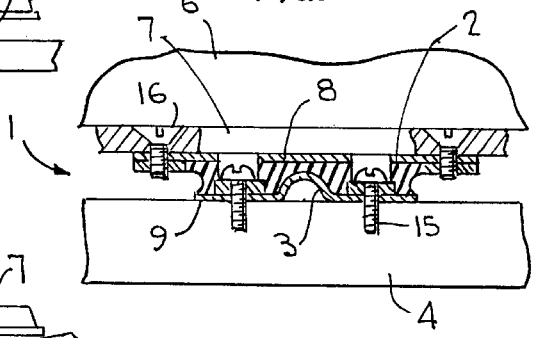
FIG. 2 is a sectional view taken along line 2—2 of FIG. 1.
Figure 1B:
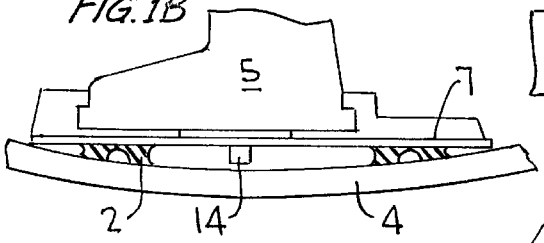

The connector plate, as in FIG. 1 and FIG. 2, comprises two connecting segments 1, situated between the ski 4 and the ski boot 5, that is to say the ski bindings 6. The connecting segments are joined from their upper surface via an interconnecting element 7 adapted for the mounting of the ski binding. On its lower surface between the connecting segments 1 is situated a dampening unit 14. Each connecting segment 1 is constructed from an elastic layer 2 of rubber, sandwiched between an upper 8 and a lower 9 mounting plate. Within the elastic layer 2 of each connecting segment 1, perpendicular to its longitudinal axis, which corresponds to the longitudinal axis of the ski 4 lies a solid supporting element 3 which acts to diminish all significant vertical compressibility of the elastic layer 2. As seen in FIG. 2, the solid supporting element 3 is an extension of the lower mounting plate 9 into the elastic layer 2, running along the lateral axis of the connecting segment 1. The lower mounting plate 9 is secured by screws 15 to the ski 4. The upper mounting plate 8 is secured via screws 16 to the interconnecting element 7, upon which the ski bindings 6 are mounted.

As in FIG. 1, during the flexing of the ski 4, the connecting segment 1 situated under the toe of the ski boot 5, is compressed in the forward region of the elastic layer 2 in relation to the position of the solid supporting element 3, while the connecting segment 1, beneath the heal of the ski boot 5 is compressed in the rear region of the elastic layer 2, once again in relation to the solid supporting element 3. Resulting from the design of the solid supporting element 3 both connecting segments 1 satisfy the requirements for uninhibited flexing of the ski 4.

EXAMPLE 2

Figure 3:
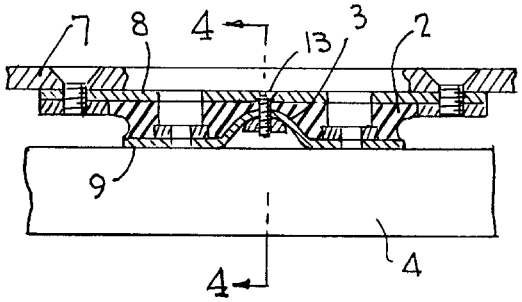
FIG. 3 is a view similar to FIG. 1 showing a connecting segment in alternative variation.
Figure 4:
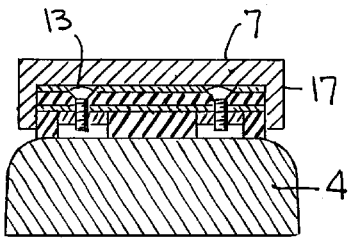
FIG. 4 is a sectional view taken along line 4—4 of FIG. 3.

According to the second variation, as in FIG. 3 and FIG. 4, the connector plate includes the same connecting segments 1 as in the first variation. They differ in that the upper mounting plate 8 and the lower mounting plate 9 are connected by two adjustable screws 13 which allow for adjustment of the density of the elastic layer 2, in addition they eliminate all lateral and vertical movements. These screws are secured within the axis of the solid supporting element 3, in this case the axis of the extension of the lower mounting plate 9. The interconnection element 7 features sidewalls 17, which cover the connector plate on the sides of the ski 4, these sidewalls 17 further eliminate all lateral movement.

EXAMPLE 3

Figure 5:
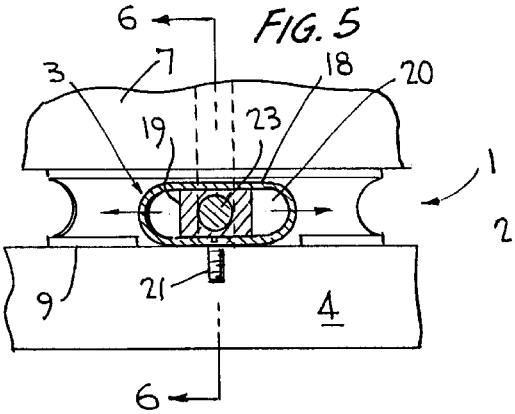
FIG. 5 is a side view of connecting segment (further variation).
Figure 6:
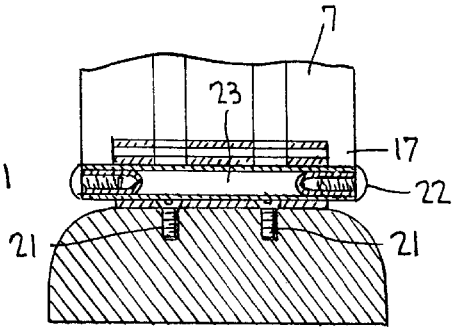
FIG. 6 is a sectional view taken along line 6—6 of FIG. 5.

According to the third variation, as in FIG. 5 and FIG. 6, the solid supporting element 3 includes a solid jacket 18, within which is located in axle 23 such that it can move longitudinally. The space 20 surrounding the axle 23 within the solid jacket 18 is filled with rubber. The solid jacket 18 is secured to the ski 4 via screws 21, which eliminates the need to use screws 15 as in the first variation. The whole connecting segment 1 is connected to the interconnecting element 7 via the axle screws 22 pinning through the sidewalls 17 and threading into axle 23. The lower mounting plate 9 is in this case separated, with the solid jacket 18 and its runner 19 located in between the two segments of the lower mounting plate 9.

EXAMPLE 4

A further variation based on the solid jacket 18 with runner 19 design is illustrated in FIG. 7 and FIG. 8, where the solid jacket 18 is built into the ski 4 as an insert, and is joined to the connecting segment 1 as in the third variation. This procedure eliminates the need for any kind of drilling and screwing into the ski 4. Alternatively as illustrated in FIG. 9, each connecting segment 1 has two solid jackets 18 and two runners 19, one on either side of the ski 4.

EXAMPLE 5

According to this the fifth variation, as in FIG. 10 and FIG. 11, both connecting segments 1 together with their solid supporting elements 3 form one single unit. This variation is advantageous for either very short skis, or for additional variability of ski flexion.

The desired effect on a ski is also achieved by further variations on the connecting segment 1, connector plate, and ski bindings or by a range of combinations between these. Illustrated in FIG. 12, marked a) through to h) are a range of various layouts and combination, of the connecting segments 1 and solid supporting elements 3. For example in variation f), situated within the elastic layer 2 are two solid supporting elements 3 of differing size, the smaller being in the compressed region of the elastic layer 2. In variation a) the solid supporting element 3 is formed by a cylindrical body inserted between the upper and lower surface of the elastic layer 2 in such a way as to allow it to rotate and slide along the lateral axis of the connecting segment 1.

Figure 13:
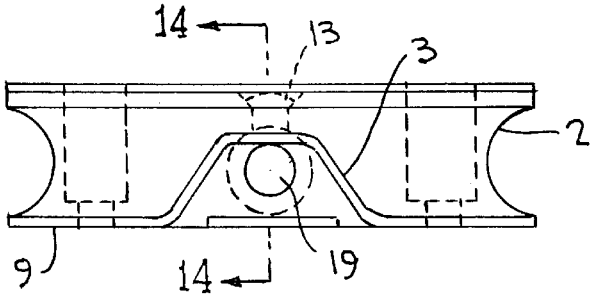
FIG. 13 is a side view of a combined version of a connecting segment.
Figure 14:
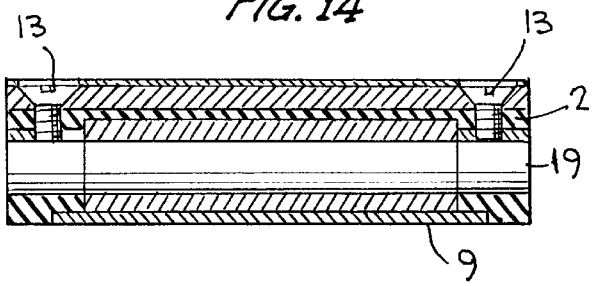
FIG. 14 is a cross-section of the connecting segment of FIG. 13 taken along line 14—14.

An example of this variation can be seen in FIG. 13 and FIG. 14, in which the solid supporting element 3, formed by an extension in the lower mounting plate 9, also forms the solid jacket 18 as well as the runner 19, in addition two adjustable screws 13 are used for varying the density of the elastic layer 2. This variation is the combination of the second and third variations demonstrated in FIG. 3 and FIG. 5.

Figure 15:
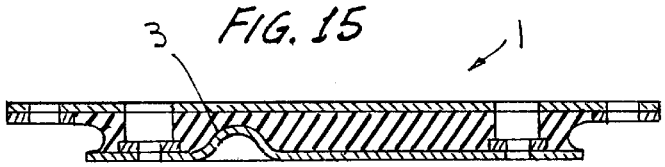
FIG. 15 is a view similar to FIG. 11 of a connecting segment with solid supporting element off center.

As shown in FIG. 15 it is possible to locate the solid supporting element 3 off the center of the lateral axis of the connecting segment 1.

Figure 16:
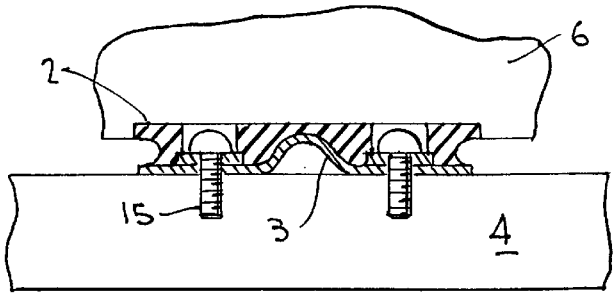
FIG. 16 is a view of a connector plate integrated with ski binding.

FIG. 16 demonstrates a further variation of the invention where the connector plate becomes a component of the ski binding 6, such that it replaces the upper mounting plates 8.

Figure 17:
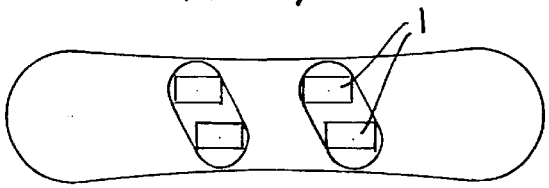
FIG. 17 is a plan view of a connector plate in a snowboard set-up.

FIG. 17 shows two connector plates as used for snowboards, in this variation, at least one connecting segment 1 is used for each mounting of boot, whose longitudinal axis runs parallel to the longitudinal axis of the snowboard, while the interconnecting elements are mounted along the longitudinal axis of each respective boot 5, or/and interconnect the connecting segments 1 along the longitudinal axis.

Reference Numerals Referring to Enclosure

1. connecting segment
2. elastic layer
3. solid supporting element
4. ski
5. ski boot
6. ski binding
7. interconnecting element
8. upper mounting plate
9. lower mounting plate
10. (unspecified)
11. (unspecified)
12. (unspecified)
13. adjustable screw
14. dampening unit
15. self tapping screws
16. joining screw
17. side wall
18. solid jacket
19. runner
20. empty space
21. securing screw,
22. axle screws
23. axle

What is claimed is:

1. A connector plate for ski bindings of snow skis or snowboards which includes two connecting segments (1) each comprising an elastic layer (2) of an elastic material, wherein the elastic layer (2) of the two connecting segments (1) within which is located in its lateral axis which lies perpendicular to the longitudinal axes of the ski (4) or snowboard at least one solid supporting element (3) which divides the elastic layer (2) into two regions, from which one region is compressed and the other expands during the flexing of the ski (4) or snowboard, the supporting element allowing for longitudinal movement in the elastic layer (2) of the connecting segment (1), all of which takes place while both the connecting segments (1) are connected via an upper surface thereof.

2. The connector plate according to claim 1, wherein the elastic layer (2) of the connecting segment (1) is conditioned by a lower mounting plate (9).

3. The connector plate according to claim 2, wherein the elastic layer (2) is conditioned by an upper mounting plate (8).

4. The connector plate according to claim 3, wherein the solid supporting element (3) comprises a protrusion of the upper or the lower mounting plates (8, 9), or combination of both, into the elastic layer (2).

5. The connector plate according to claim 3, wherein the upper mounting plate (8), and the lower mounting plate (9), are interconnected by at least two adjustable screws (13) for varying the density of the elastic layer (2), the screws being secured on the axis of the solid supporting element (3).

6. The connector plate according to claim 3, wherein the lower mounting plate (9) is divided into at least two parts, which are interconnected by the material of the elastic layer (2).

7. The connector plate according to claim 3, wherein the solid supporting element (3) is set in the lateral axis of the connecting segment (1).

8. The connector plate according to claim 3, wherein the solid supporting element (3) is set off center to the lateral axis of the connecting segment (1).

9. The connector plate according to claim 3, wherein the connecting segments (1) are connected longitudinally by an adjustable inter-connecting element (7).

10. The connector plate according to claim 3, wherein the connecting segments (1) are connected by an interconnecting element (7), formed as a rigid unit.

11. The connector plate according to claim 3, wherein between the connecting segments (1) in a space between the ski (4) and an interconnecting element (7), is located at least one dampening unit (14).

12. The connector plate according to claim 1, wherein the solid supporting element (3) comprises an elastically mounted runner (19), allowing for longitudinal movement.

13. The connector plate according to claim 12, wherein the runner (19) is set into a solid jacket 18, within which a space (20) is filled with either rubber or another elastic material.

14. The connector plate according to claim 1, wherein both connecting segments (1) are constructed as one unit.

15. The connector plate according to claim 1, wherein the connecting segments (1) are integrated directly into the binding (6).

16. The connector plate according to claim 1, wherein the connecting segments (1) are integrated into the ski (4) or snowboard, by being connected to a runner (19), which is set in a solid jacket (18), a component of the connecting segment.

17. The connector plate according to claim 1, wherein the elastic layer (2) is of an elastic material of varying degrees of density.

18. The connector plate according to claim 1, wherein within the elastic layer (2) are internal cavities.

* * * * *